US009741465B2

(12) United States Patent
Gross et al.

(10) Patent No.: US 9,741,465 B2
(45) Date of Patent: Aug. 22, 2017

(54) ELECTRICAL CABLE ASSEMBLY

(71) Applicant: FCI Americas Technology LLC, Carson City, NV (US)

(72) Inventors: Charles M. Gross, Etters, PA (US); Joshua A. Garman, Mount Holly Springs, PA (US)

(73) Assignee: FCI Americas Technology LLC, Carson City, NV (US)

( * ) Notice: Subject to any disclaimer, the term of this patent is extended or adjusted under 35 U.S.C. 154(b) by 44 days.

(21) Appl. No.: 14/089,125

(22) Filed: Nov. 25, 2013

(65) Prior Publication Data

US 2014/0182890 A1 Jul. 3, 2014

Related U.S. Application Data

(60) Provisional application No. 61/747,424, filed on Dec. 31, 2012.

(51) Int. Cl.
*H01B 7/08* (2006.01)
*H01B 7/00* (2006.01)
(Continued)

(52) U.S. Cl.
CPC ..... *H01B 7/00* (2013.01); *H01B 7/0861* (2013.01); *H01R 12/53* (2013.01);
(Continued)

(58) Field of Classification Search
CPC ..... H01B 7/08
(Continued)

(56) References Cited

U.S. PATENT DOCUMENTS 4,488,125 A 12/1984 Gentry et al.
5,091,610 A * 2/1992 Strauss ..... 174/117 F
(Continued)

FOREIGN PATENT DOCUMENTS

JP 2002/184540 6/2002
JP 2002-334615 A 11/2002
(Continued)

OTHER PUBLICATIONS

Partial Supplementary European Search Report for European Application No. 13867907.1 dated Aug. 31, 2016.
(Continued)

*Primary Examiner* — Chau N Nguyen
(74) *Attorney, Agent, or Firm* — Wolf, Greenfield & Sacks, P.C.

(57) ABSTRACT

In accordance with an embodiment, an electrical cable can be configured to electrically connect to contact pads that are carried by a substrate. The electrical cable can include at least one, such as a pair, of electrical signal conductors and at least one, for instance a pair, of electrically conductive drain wires. A drain wire in the electrical cable can define a first surface that is configured to face the signal conductors and a second surface that is opposite the first surface. The drain wire can define a width that is greater than 0.12 mm as measured from the first surface to the second surface along a straight line. At least one auxiliary wire can be attached to at least one drain wire. The auxiliary wire can be configured to attach to the substrate.

21 Claims, 4 Drawing Sheets

(51) Int. Cl.

| | |
|---|---|
| ***H01R 12/53*** | (2011.01) |
| ***H01R 13/6592*** | (2011.01) |
| *H01R 4/02* | (2006.01) |
| *H01R 43/28* | (2006.01) |

(52) U.S. Cl.
CPC ..... *H01R 13/6592* (2013.01); *H01R 4/023* (2013.01); *H01R 43/28* (2013.01); *Y10T 29/49117* (2015.01)

(58) Field of Classification Search
USPC ..... 174/115, 117 F
See application file for complete search history.

(56) References Cited

U.S. PATENT DOCUMENTS

| | | | | |
|---|---|---|---|---|
| 5,867,896 | A | 2/1999 | Watanabe | |
| 6,288,372 | B1 | 9/2001 | Sandberg et al. | |
| 6,444,902 | B1 | 9/2002 | Tsao et al. | |
| 6,448,500 | B1 * | 9/2002 | Hosaka et al. | 174/113 R |
| 6,540,559 | B1 | 4/2003 | Kemmick et al. | |
| 6,674,007 | B2 | 1/2004 | Ide et al. | |
| 6,677,518 | B2 | 1/2004 | Hirakawa et al. | |
| 6,689,958 | B1 * | 2/2004 | McKenney | H01B 7/0009 174/113 R |
| 6,740,808 | B1 * | 5/2004 | Chang | 174/36 |
| 6,781,061 | B2 | 8/2004 | Tanaka | |
| 6,977,344 | B2 * | 12/2005 | Tanaka | 174/117 F |
| 7,358,443 | B2 * | 4/2008 | Shatkin et al. | 174/102 R |
| 7,999,185 | B2 | 8/2011 | Cases et al. | |
| 8,039,746 | B2 | 10/2011 | Ashida et al. | |
| 8,267,718 | B2 | 9/2012 | Straka et al. | |
| 8,407,977 | B2 * | 4/2013 | Cheng et al. | 57/212 |
| 8,866,017 | B2 | 10/2014 | Tanabe | |
| 2003/0111255 | A1 * | 6/2003 | Buck et al. | 174/113 R |
| 2004/0154826 | A1 | 8/2004 | Tanaka | |
| 2005/0272303 | A1 * | 12/2005 | Wu | H01R 9/03 439/499 |
| 2009/0314511 | A1 | 12/2009 | Hagi et al. | |
| 2013/0168149 | A1 * | 7/2013 | Gundel | H01B 7/0861 174/350 |
| 2014/0182885 | A1 * | 7/2014 | Gross et al. | 174/117 F |

FOREIGN PATENT DOCUMENTS

| | | | |
|---|---|---|---|
| JP | 2003/297155 | | 10/2003 |
| JP | 2004/079439 | | 3/2004 |
| JP | 2005/135839 | | 5/2005 |
| JP | 2010/218741 | | 9/2010 |
| WO | WO 2012/120993 | * | 9/2012 |

OTHER PUBLICATIONS

Partial Supplementary European Search Report for European Application No. 13869479.9 dated May 6, 2016.
Extended European Search Report for European Application No. 13869479.9 dated Aug. 24, 2016.
International Search Report and Written Opinion for International Application No. PCT/US2013/076883 dated Apr. 15, 2014.
International Preliminary Report on Patentability for International Application No. PCT/US2013/076883 dated Jun. 30, 2015.
International Search Report and Written Opinion for International Application No. PCT/US2013/074985 dated Apr. 8, 2014.
International Preliminary Report on Patentability for International Application No. PCT/US2013/074985 dated Jul. 9, 2015.

* cited by examiner

ELECTRICAL CABLE ASSEMBLY

CROSS REFERENCE TO RELATED APPLICATIONS

This application claims the benefit of U.S. Provisional Patent Application Ser. No. 61/747,424 filed Dec. 31, 2012, the disclosure of which is hereby incorporated by reference as if set forth in its entirety herein.

This application is related to co-pending U.S. application Ser. No. 14/089,163, filed on Nov. 25, 2013, entitled "ELECTRICAL CABLE ASSEMBLY."

BACKGROUND

Electrical cable assemblies can be used to electrically connect one electrical component to another electrical component. For instance, as illustrated in FIG. 1A, an electrical cable assembly 10 can include a substrate 12, such as a printed circuit board 14, a set of electrical cables 16 that includes a plurality of electrical cables 18 configured to be mounted to the substrate 12 so as to be placed in electrical communication with respective electrically conductive traces of the substrate 12. The substrate 12 includes a substrate body 20 that defines a pair of opposed surfaces, for instance an upper surface 20*a* and an opposed lower surface 20*b* that is spaced from the upper surface 20*a* along a transverse direction T. The substrate body 20 can further define a rear end 20*c* configured to mate with a complementary electrical component and an opposed front end 20*d* that is spaced from the rear end 20*c* along a longitudinal direction L that is substantially perpendicular to the transverse direction T. The substrate body 20 can further define opposed sides 20*e* that are spaced from each other along a lateral direction A that is substantially perpendicular to both the transverse and longitudinal directions T and L, respectively.

Still referring to FIG. 1A, at least one or both of the upper and lower surfaces 20*a* and 20*b*, respectively, can support respective pluralities of electrical contact pads 22. The contact pads 22 can be configured to electrically connect to respective ones of the electrical cables 18. The contact pads 22 can be in electrical communication with one or more electrical traces carried by or located in substrate body 20, and can thus be in electrical communication with complementary contact pads of the substrate 12. Accordingly, cables 18 mounted to the contact pads 22 can be placed into electrical communication with the complementary contact pads, and thus can be placed in electrical communication with a complementary electrical component that is mated with the complementary contact pads. In particular, proximal ends 24 of the cables 18 can define mounting ends that are mounted to respective ones of the contact pads 22.

In accordance with the illustrated example, the contact pads 22 are supported by the lower surface 20*b* of the substrate 12. Each of the contact pads 22 can be spaced from each other along the lateral direction A and can be disposed proximate to the front end 20*d*. The contact pads 22 may include a plurality of signal contact pads 22*a* and a plurality of ground contact pads 22*b*. Signal contact pads 22*a* and ground contact pads 22*b* can be arranged in a row R1. Within row R1, signal contact pads 22*a* and ground contact pads 22*b* may be in a repeating signal-signal-ground pattern, a ground-signal-signal pattern, or a signal-ground-signal pattern. Signal contact pads 22*a* and ground contact pads 22*b* can also be arranged in a repeating signal-signal-ground-ground pattern, a ground-signal-signal-ground pattern (FIG. 1A), or a signal-ground-signal-ground pattern.

With continuing reference to FIG. 1A, the substrate 12 can include at least one common ground element, such as ground element 26. As illustrated, the common ground element 26 can be an electrical layer(s) that is carried on the lower surface 20*b* of the substrate body 20. The ground elements 26 can be electrically isolated from the contact pads 22. In accordance with the illustrated example, the ground element 26 can be disposed at a location that is closer to the front end 20*d* along the longitudinal direction L than the contact pads 22. The ground contact pads 22*b* can be commoned to the ground member 26 by one or more electrical traces carried on the surfaces 20*b* of the substrate body 20 or layers located in the substrate body 20 between surfaces 20*a* and 20*b*.

Referring to FIGS. 1A-C, the cables 18 can each include at least one conductor 28, such as a pair of signal carrying conductors 28*a*, and an electrically insulative signal layer 30 that surrounds at least a portion of each of the signal carrying conductors 28*a*. Each of the cables 18 can further include an electrically conductive ground jacket 32 that surrounds the respective insulated layer 30 of the signal carrying conductors 28*a*. The ground jacket 32 may be configured to be electrically connected to a respective ground plane of a complementary electrical component to which the cable 18 is mounted. For instance, the ground jacket 32 of a respective cable 18 may be configured to be placed into contact with a ground element 26 of the substrate 12, such that the ground jacket 32 of the respective cable 18 is connected to the ground plane of the substrate 12 via the ground element 26. In this regard, the ground jacket 32 can provide an electrical path to ground, or ground path from the ground jacket 32 of the respective cable 18 to the respective ground plane of the complementary electrical component. Each of the cables 18 can further include an outer layer 34 that is electrically insulative and surrounds the respective ground jacket 32. For instance, insulative layer 30 can be disposed within insulative layer 34. The insulative layers 30 and 34 can be spaced apart from each other along the lateral direction A. The insulative layers 30 and 34 can be constructed of any suitable dielectric material, such as plastic. The conductors 28 can be constructed of any suitable electrically conductive material, such as copper.

The cables 18 may further include at least one ground conductor, such as drain wires 28*b*, in addition to signal conductors 28*a*. The drain wires 28*b* can be used in combination with the ground jacket 30 or by themselves. The drain wires 28*b* can be surrounded by the outer layer 34. A drain wire 28*b* may also be surrounded by the ground jacket 32, when a ground jacket is present.

The cables 18 can be configured to mount to the contact pads 22, for instance at their respective proximal ends 24. Thus, the cables 18 can be in electrical communication with the respective complementary contact pads 22. Each of the cables 18 can be mounted to the substrate 12 in a variety of ways. For instance, a portion of the insulative layers 30 and 34 and the ground jacket 32 of each cable 18 can be removed from the respective conductor 28 at the proximal end 24 so as to expose the conductors 28. Alternatively, the cable 18 can be manufactured such that the conductors 28 extend longitudinally out from the insulating layers 30 and 34 and the ground jacket 32 so as to expose the conductors 28. The exposed conductors 28 can be mounted to respective contact pads 22 at the proximal end 24, for instance by soldering the conductors 28 to the contact pad 22. For instance, signal carrying conductors 28*a* can define signal mounting portions

36*a* that are exposed such that the mounting portions 36*a* extend from an insulative layer along the longitudinal direction L and terminate at the proximal end 24. The signal mounting portions 36*a* can be mounted to signal contact pads 22*a*. Similarly, drain wires 28*b* can define drain mounting portions 36*b* that are exposed such that the mounting portions 36*b* extend from an insulative layer along the longitudinal direction L and terminate at the respective proximal end 24. The mounting portions 36*b* of the drain wires 28*b* can be mounted to ground contact pads 22*b*.

Referring to FIG. 1B, the illustrated cables 18 can have an American wire gauge (AWG) of 30. The illustrated signal conductors 28*a* in the 30 AWG cable have a diameter D1 of about 0.25 mm and the illustrated drain wires 28*b* have a diameter of 0.2 mm. Referring to FIG. 1C, the illustrated cables 18 can have an AWG of 26. Thus, the illustrated signal conductors 28*a* in the 26 AWG cable shown in FIG. 1C have a diameter D2 of 0.4 mm and the illustrated drain wires 28*b* have a diameter of 0.2 mm.

In connecting high speed signal cables to a substrate, insulating layers of the cable may be removed thereby exposing signal conducts. These exposed signal conductors may result in electromagnetic interference, such as cross talk. Mitigating such electromagnetic interference is desirable.

SUMMARY

In accordance with one embodiment, an electrical cable can be configured to electrically connect to contact pads that are carried by a substrate. The electrical cable can include an electrical insulator and first and second electrical signal conductors, and respective portions of each of the first and second electrical signal conductors can be disposed within the insulator. The electrical cable can further include first and second drain wires having respective portions disposed within the insulator and spaced apart from each other along a first direction such that the first and second electrical signal conductors are disposed between the first and second drain wires along the first direction. Each of the first and second drain wires can be elongate along a second direction that is substantially perpendicular to the first direction, and each of the first and second drain wires can define an outer perimeter having first and second opposed surfaces that are spaced from each other along the first direction. The electrical cable can further include an electrically conductive auxiliary wire that defines an outer perimeter that is attached to the outer perimeter of at least a select one of the first and second drain wires. For instance, the auxiliary wire can be attached to the drain wire such that both of the wires can abut the substrate when the electrical cable is electrically connected to the contact pads that are carried by the substrate.

BRIEF DESCRIPTION OF THE DRAWINGS

The foregoing summary, as well as the following detailed description of an example embodiment of the application, will be better understood when read in conjunction with the appended drawings, in which there is shown in the drawings example embodiments for the purposes of illustration. It should be understood, however, that the application is not limited to the precise arrangements and instrumentalities shown. In the drawings.

DETAILED DESCRIPTION

Applicants have recognized that varying the size and/or shape of the drain wires in various configurations reduces cross-talk in high speed signal cables. In particular, applicants have recognized that increasing the width of a drain wire can reduce cross-talk in cable assemblies and/or can increase the density of electrical cable assemblies. While various configurations are described herein with reference to preferred embodiments and/or preferred methods, it should be understood that the words which have been used herein are words of description and illustration, rather than words of limitation, and that the scope of the instant disclosure is not intended to be limited to those particulars, but rather is meant to extend to all structures, methods, and/or uses of the herein described cables. Those skilled in the relevant art, having the benefit of the teachings of this specification, may effect numerous modifications to the electrical cables as described herein, and changes may be made without departing from the scope and spirit of the instant disclosure, for instance as recited in the appended claims.

Figure 2:
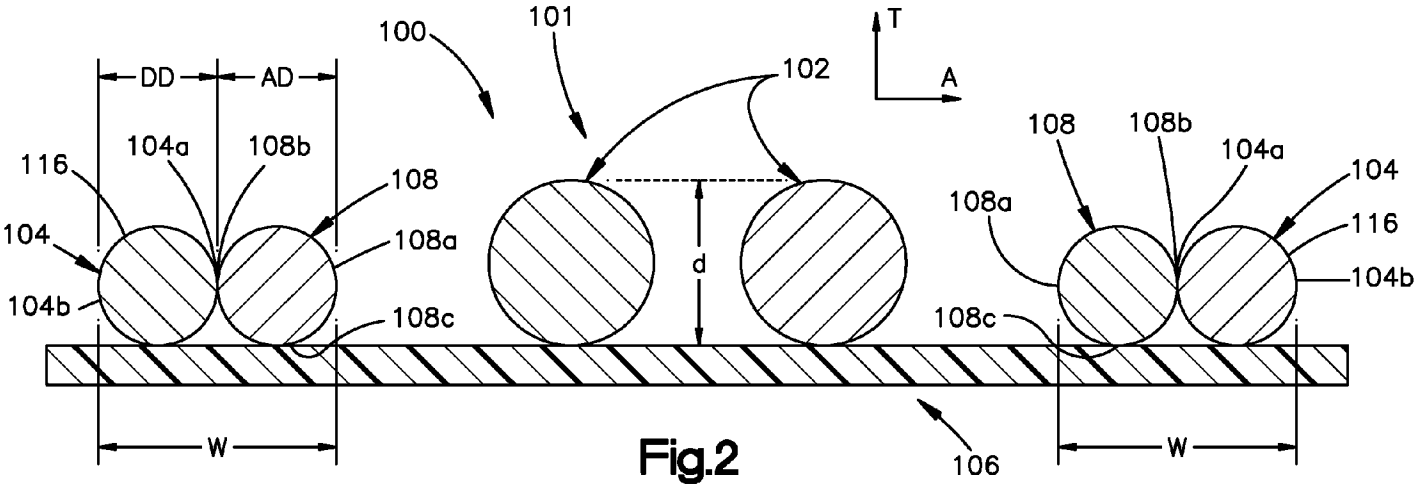
FIG. 2 is a section elevation view of the mounting portion of an electrical cable with auxiliary wires connected to the drain wires in accordance with an embodiment.

Referring to FIG. 2, in accordance with an embodiment, an electrical cable 100 can be configured to electrically connect to contact pads that are carried by a substrate 106. The electrical cable assembly 101 can include the electrical cable 100 and the substrate 106 that carries a plurality of signal contact pads and ground contact pads disposed between ones of the signal contact pads, and each of the electrical signal conductors 102 can be mounted to respective signal contact pads and each of the drain wires 104 can be mounted to respective ground contact pads. For instance, a cable 18 in the electrical cable assembly 10 can be configured as the cable 100. The electrical cable assembly 101 can include an electrical cable 100 and a substrate 106, such as a printed circuit board. The electrical cable 100 can include an electrical insulator and at least one electrical signal conductor having a portion disposed within the insulator, and at least one drain wire having a portion disposed within the insulator. As illustrated, the electrical cable 100 includes a pair of electrically conductive signal conductors 102 that are spaced apart from each other along a first or lateral direction A. The electrical signal conductors 102 can be elongate in a second or longitudinal direction L that is substantially perpendicular to the lateral direction A. The electrical cable 100 can further include electrically conductive drain wires 104, such as first and second drain wires 104. The drain wires 104 can be spaced from each other and from the pair of signal conductors 102 along the lateral direction A such that the pair of electrical signal conductors 102 are disposed between the first and second drain wires along the lateral direction A. While the electrical cable 100 is illustrated herein as having two signal conductors between two drain wires, it will be understood that the electrical cable 100 can be constructed as desired. For instance, one or more signal conductors and one or more ground conductors can be arranged in an electrical cable 100 so as to form other orders along a direction besides the illustrated ground-signal-signal-ground order, such as signal-signal-ground, ground-signal-signal, signal-ground-signal, signal-signal-ground-ground, ground-signal-signal-ground pattern, or signal-ground-signal-ground.

The electrical cable 100 can include at least one electrically conductive signal conductor 102, for instance a pair of signal conductors 102, that defines a cylindrical body such as to define a substantially circular cross section in a plane defined by the lateral and transverse directions A and T, respectively. A diameter d can define the diameter of the substantially circular cross section of the signal conductor 102. The diameter d can be least 0.12 millimeters (mm) and less than 1.0 mm. For instance, and without limitation, the electrical cable 100 can have an American Wire Gauge (AWG) of 36, 30, 26, or 22, and the diameter d can be about 0.13 mm, 0.25 mm, 0.4 mm, or 0.64 mm, respectively. The electrical cable 100 can further include at least one electrically conductive drain wire 104, for instance a pair of drain wires 104 in accordance with the illustrated embodiment, that is disposed adjacent to at least one signal conductor 102. At least a portion of at least one drain wire 104 can define a first or inner side surface 104*a* that is configured to face at least one electrically conductive signal conductor 102, such as a first and second signal conductor 102. At least a portion of the at least one drain wire 104 can further define a second or outer side surface 104*b* that is opposite the inner side surface 104*a*. At least one drain wire 104, such as a first and second drain wire 104 in accordance with the illustrated embodiment, can define a drain distance DD measured from the respective inner side surface 104*a* to the respective outer side surface 104*b* along a straight line. The drain wire 104 can further define an outer perimeter 116. Thus, each of the first and second drain wires 104 can define the outer perimeter 116 having the inner and outer side surfaces 104*a* and 104*b*, which can be referred to as first and second opposed surfaces 104*a* and 104*b*, respectively, that are spaced from each other along the lateral direction A.

Figure 1A:
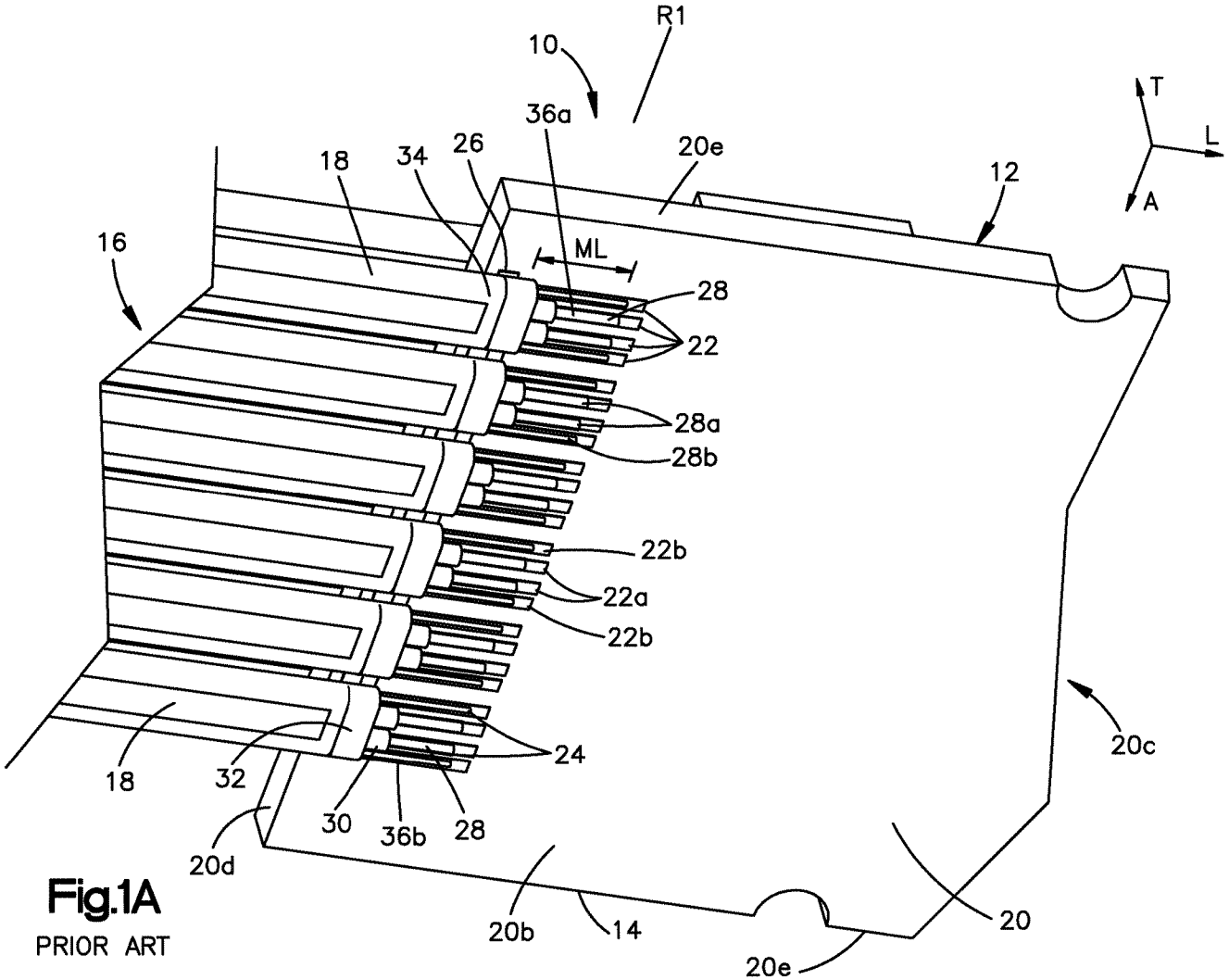
Fig.1A PRIOR ART
FIG. 1A is a perspective view of an example electrical assembly including conventional electrical cables.
Figure 1B:
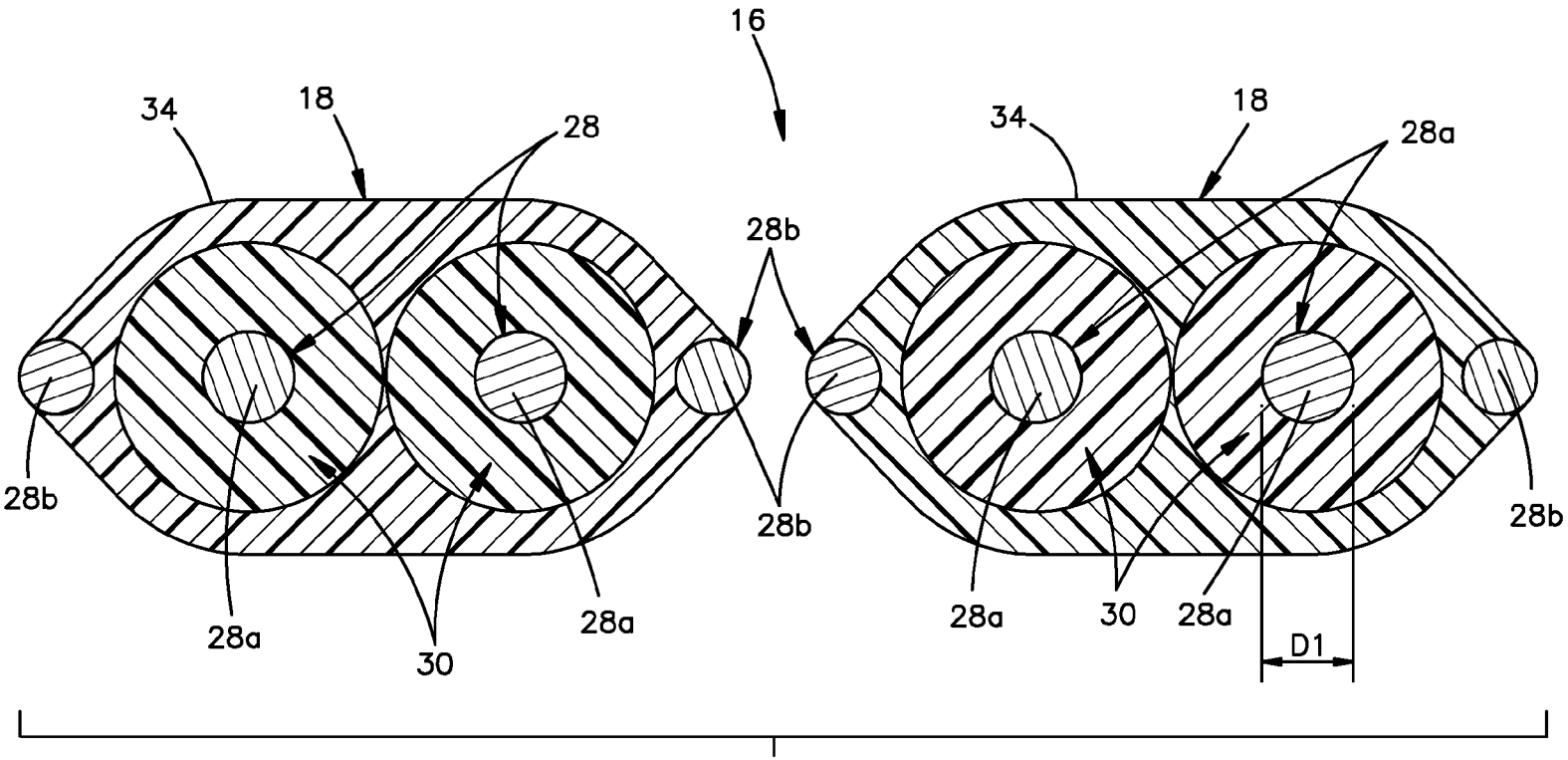
Fig.1B PRIOR ART
FIG. 1B is section elevation view of two conventional cables illustrated in FIG. 1A.
Figure 1C:
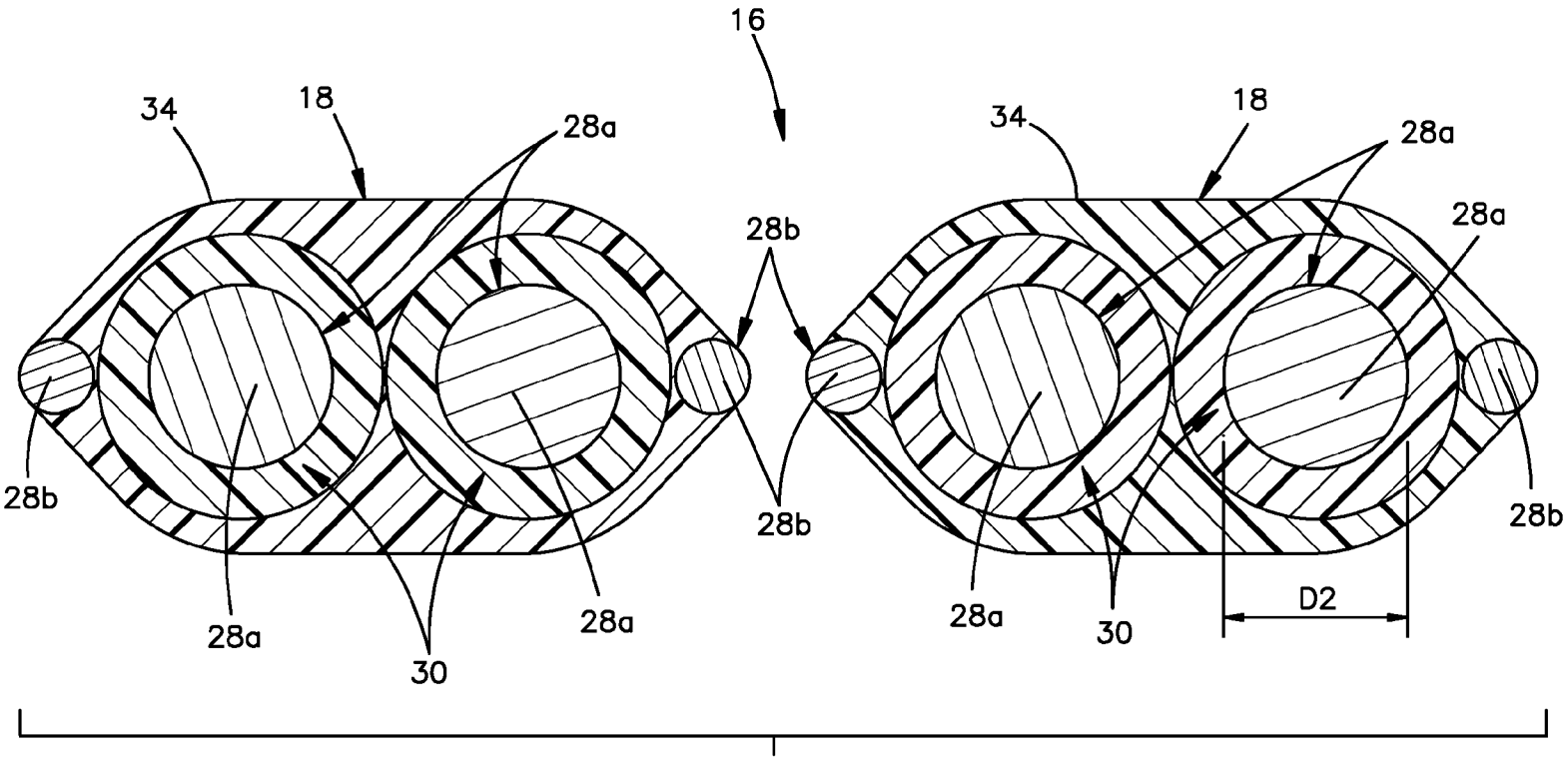
Fig.1C PRIOR ART
FIG. 1C is a section elevation view of another two conventional cables illustrated in FIG. 1A.

The electrical cable 100 can include a first electrical insulator, such as the outer layer 34 shown in FIG. 1 for instance, that surrounds at least one drain wire 104 along at least a portion of a length of the at least one drain wire 104. For instance, the first and second drain wires 104 can each be substantially surrounded along at least a portion of their respective lengths by a respective first insulator. The electrical cable 100 can further include a second electrical insulator, such as the insulative signal layer 30 shown in FIG. 1 for instance, that substantially surrounds the at least one signal conductor 102 along at least a portion of a length of the at least one signal conductor 102. For instance, the first and second electrical signal conductors 102 can each be substantially surrounded along at least a portion of their respective lengths by a respective second insulator. At least one signal conductor 102 and at least one drain wire 104 can be adjacent each other along the lateral direction A, and each of the drain wires 104 and the signal conductors 102 can define respective mounting portions that extend from the first and second insulators, respectively, along the longitudinal direction L that is substantially perpendicular to the lateral direction A. The diameter d of the signal conductor 102 can be measured at its respective mounting portion along a third or transverse direction T that is substantially perpendicular to both the lateral and longitudinal directions A and L, respectively. The diameter d and the drain distance DD can be measured at the respective mounting portions along the lateral direction A. The first and second insulators can be spaced from each other along the lateral direction A. The second insulator can be disposed within the first insulator, such as when the second insulator is configured as the signal layer 30 and the first layer is configured as the outer layer 34 for instance. Alternatively, the first insulator and the second insulator can be configured as the same insulator, and thus the respective mounting portions of both the drain wire 104 and the signal conductor 102 can extend from the same insulator.

The drain wires 104 can include respective mounting portions that can be defined by the portions of the drain wires 104 that extend out from an insulative layer along the longitudinal direction L so as to expose the drain wires 104. The mounting portions can thus be mounted to respective electrical contacts on the substrate 106. The drain wires 104 can be exposed when they are not surrounded by an insulative layer of the electrical cable 100. The mounting portion, and thus the drain wire 104, can define a mounting length ML that can span the mounting portion along the longitudinal direction L. With reference to FIG. 1, the mounting length ML can extend out from the ground jacket 32 along the longitudinal direction L to the proximal end 24. Alternatively, when the cable 100 is constructed without a ground jacket for instance, the mounting length ML can extend from the insulative layer 34 to the proximal end 24 along the longitudinal direction L. At least a portion, for instance all, of the mounting portion of the drains wires 104 can define the drain distance DD.

With continuing reference to the illustrated embodiment in FIG. 2, an electrical cable 100 that is configured to electrically connect to the substrate 106 can include an electric insulator, first and second signal conductors 102, and first and second drain wires 104. Respective portions of the signal conductors 102 and each of the drain wires 104 can be disposed within the insulator. The drain wires 104 can be spaced apart along a first or lateral direction A such that the first and second electrical signal conductors 102 are disposed between the first and second drain wires 104 along the lateral direction A. Each of the first and second drain wires 104 can be elongate along a second or longitudinal direction L, and each of the first and second drain wires 104 can define the outer perimeter 116 having first and second opposed surfaces 104*a* and 104*b*, respectively, that are spaced from each other along the lateral direction A. The electrical cable can further include an electrically conductive auxiliary wire 108 that defines an outer perimeter 114 that is attached to the outer perimeter 116 of at least a select one of the first and second drain wires 104. At least the select one of the first and second drain wires 104 can define the mounting portion that extends out from the insulator along the longitudinal direction L, and the auxiliary wire 108 can be attached to the outer perimeter 116 of the mounting portion of at least one of the first and second drain wires 104. Thus, the mounting portion can define the first or inner surface 104*a* that can be configured to face the signal conductors 102. The mounting portion can further define the second or outer surface 104*b* that is opposite the inner surface 104*a*.

In accordance with the illustrated embodiment shown in FIG. 2, the auxiliary wire 108 can attach to the inner surface 104*a* of at least a select one of the first and second drain wires 104. Alternatively, the auxiliary wire 108 can define a first or inner surface 108*a* that can be attached to the outer surface 104*b* of at least one of the drain wires 104. The auxiliary wire 108 can further define a second or outer surface 108*b* that is opposite the inner surface 108*a* and spaced from the inner surface 108*a* an auxiliary distance AD. The auxiliary wire 108 can further define a third or bottom surface 108*c* that is configured to abut or attach to the substrate 106. In accordance with the illustrated embodiment, the outer surface 108*b* can be attached to the inner surface 104*a* of at least one select drain wire 104. The inner and outer surfaces 104*a* and 104*b*, respectively, of the mounting portion of the drain wire 104 can be spaced apart the drain distance DD. In accordance with the illustrated embodiment, the drain distance DD can be substantially equal to the auxiliary distance AD. It will be appreciated that the drain distance DD and the auxiliary distance AD can vary as desired, for instance the auxiliary distance can be greater than the drain distance DD or less than the drain distance DD. It will be further appreciated that auxiliary wires can be electrically attached to drain wires using any appropriate attachment mechanism as desired, such as welding, soldering, applying a conductive adhesive, potting in conductive material, or a combination thereof. The auxiliary wire 108 can be physically attached, directly or indirectly, to the drain wire 104. For instance a drain wire and an auxiliary wire can be indirectly attached to each other via a common pad or an intermediate conductive member between the wires.

In accordance with illustrated embodiment, the select one of the first and second drain wires 104 and the auxiliary wire 108 can define a width W, which can also be referred to as a maximum width W, that extends from the outer surface 104*b* of the select one of the first and second drain wires 104 to the inner surface 108*a* of the auxiliary wire 108 that is attached to the select one drain wire 104. Alternatively, the select one of the first and second drain wires 104 and the auxiliary wire 108 can define the width W that extends from the inner surface 104*a* of the select one of the first and second drain wires 104 to the outer surface 108*b* of the auxiliary wire 108 that is attached to the select one drain wire 104. Thus, it can be said that the select one of the first and second drain wires 104 and the auxiliary wire 108 can define the maximum width W along the lateral direction A that is equal to the sum of the drain distance DD and the auxiliary distance AD, and the maximum width can be greater than the diameter d. The width W can be at least equal to the diameter d, in accordance with the illustrated embodiment. The width can be greater than 0.12 mm and less than 1.5 mm, for instance 0.15 mm or 1.3 mm.

Figure 3:
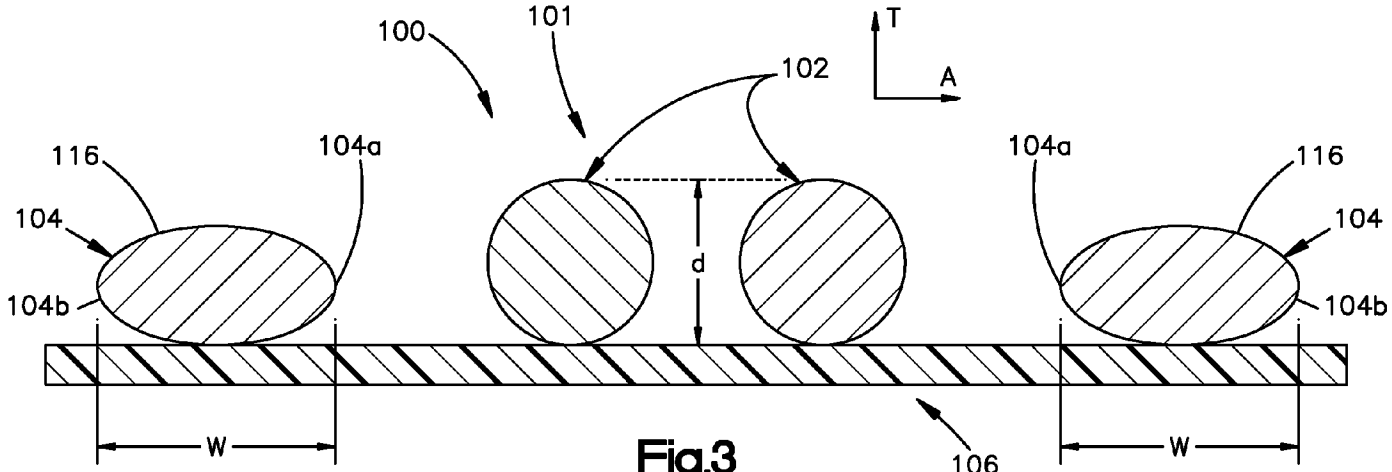
FIG. 3 is a section elevation view of the mounting portion of an electrical cable with formed drain wires in accordance with another embodiment.

Referring to the illustrated embodiment shown in FIG. 3, the drain wire 104 can define the width W, and the width W can be greater than 0.12 mm and less than 1.5 mm, for instance about 0.15 mm in a 36 AWG cable or about 1.3 mm in a 22 AWG cable. For instance, at least one electrically conductive drain wire 104 can be disposed adjacent at least one electrically conductive signal conductor 102, wherein at least a portion of the at least one drain wire defines a first surface 104*a* configured to face the at least one electrically conductive signal conductor and a second surface 104*b* opposite the first surface. In accordance with the illustrated embodiment, the at least one drain wire 104 can define a width W greater than 0.12 mm and less than 1.5 mm, for instance greater than 0.2 mm and less than 1.3 mm, as measured from the respective first surface 104*a* to the respective second surface 104*b* along a straight line. For instance, the width W can be greater than 0.2 mm when the cable 100 has an AWG of 30. In an example embodiment, the cable 100 can have an AWG of 22 and the width W can be approximately 1.3 mm. As illustrated, the electrical cable 100 can include first and second electrically conductive signal conductors 102 that are each disposed between first and second electrically conductive drain wires 104 along the straight line.

Still referring to FIG. 3, in accordance with the illustrated embodiment, the width W drain can define a major axes of a substantially elliptical cross section, although it will be appreciated that the drain wires 104 are not limited to defining elliptical cross sections. The drain wires 104 illustrated in FIG. 3 can be formed with compression techniques, and thus they can be referred to as compressed or formed drain wires.

Referring also to FIG. 2, it will be appreciated that the width W and the diameter d can vary as desired. In one embodiment, the distance between two signal conductor pairs 102 along the lateral direction A does not change as the width W is increased, thereby reducing crosstalk. In another embodiment, the distance between two signal conductor pairs can decrease as the width W is increased so as increase the density (e.g., decrease the distance between signal pairs) of the electrical cable 100. In accordance with the illustrated embodiment of FIG. 2, the electrical cable 100 includes a second auxiliary wire 108 that is attached to the drain wire 104, although it will be understood that the electrical cable 100 can be constructed with any number of auxiliary wires as desired. For instance, it will be understood that only one auxiliary wire 108 can be attached to each of the drain wires 104 as desired. Further, it will be appreciated that auxiliary wires 108 can be attached to each other as desired.

The width W can be greater than 0.12 mm and less than 1.5 mm, for instance greater than 0.2 mm and less than 1.3 mm, for instance 0.5 mm or 1.0 mm. For instance, and without limitation, the width W can be approximately 0.4 mm. Such a width can be achieved by two 0.2 mm drain wires, for instance the drain wire 104 and the auxiliary wire 108, side-by-side along the lateral direction A. Side-by-side drain wires can define the width W that is greater than 0.12 mm, for instance if an intermediate conductive member is placed between the drain wires. Alternatively, with reference to FIG. 3, such a width can be achieved by one 0.4 mm drain wire. It will be appreciated that while the illustrated embodiment of FIG. 2 shows a stack of one auxiliary wire 108 on each drain wire 104, one or more auxiliary wires, for instance 2, 3, 4, or 5, can be stacked along the lateral direction A in any desired arrangement. The auxiliary wire 108 can have the same shape and properties as the drain wire 104, and thus an auxiliary wire can be referred to as a drain wire. Further, it will be appreciated that auxiliary wires 108 can be attached to other surfaces of the drain wire 104 as desired. The auxiliary 108 wires can define a length that is at least a portion, for instance all, of the length of the mounting portion of the drain wire 104. Thus, the auxiliary wire 108 can define a length that is substantially equal to the length of mounting portion of the drain wire 104. Thus, at least a portion of the mounting portion, for instance all, of the drain wire 104 can carry at least one auxiliary wire 108. Further, the auxiliary wire 108 can ride along at least a portion, for instance all, of the length of the drain wire 104. Thus, the auxiliary wire 108 can define a length that is substantially equal to the length of the mounting portion of the at least one select drain wire 104 to which it is attached.

Referring still to FIG. 2, a method of fabricating the electrical cable 100 that is configured to electrically connect to the substrate 106 and includes at least one drain wire 104 and at least one signal conductor 102 can comprise defining a first surface of the drain wire 104 that is configured to face the at least one signal conductor 102. A second surface of the drain wire 104 that is opposite the first surface can be defined. At least one electrically conductive auxiliary wire can be attached to the second surface of the drain wire so as to define a maximum width that is measured from the first surface of the drain wire to a surface of the auxiliary wire along a straight line. The width can be greater than 0.12 mm and less than 1.5 mm, for instance greater than 0.2 mm and less than 1.3 mm. The surface of the auxiliary wire can be opposite the first surface of the drain wire when the auxiliary wire is attached to the drain wire. The auxiliary wire can be physically adhered to the drain wire, such as by soldering or through the use of various other adhesives as desired.

It will be appreciated that a method for reducing crosstalk can include fabricating electrical cables as described above. Further, it will be appreciated that a method for increasing the density of an electrical cable can include defining drain wires and/or auxiliary wires as described herein. For instance, drain wires and signal conductors can be spaced closer together in the electrical cables described herein than they are spaced from each other in conventional cables while achieving no more crosstalk, for instance less crosstalk, than the crosstalk that is present in conventional cables.

Although the electrical cable assembly has been described herein with reference to preferred embodiments and/or preferred methods, it should be understood that the words which have been used herein are words of description and illustration, rather than words of limitation, and that the scope of the instant disclosure is not intended to be limited to those particulars, but rather is meant to extend to all structures, methods, and/or uses of the herein described cable retention housing. Those skilled in the relevant art, having the benefit of the teachings of this specification, may effect numerous modifications to the electrical cable assembly as described herein, and changes may be made without departing from the scope and spirit of the instant disclosure, for instance as recited in the appended claims.

For instance, it should be appreciated that a means for using one or more drain wires for reducing the crosstalk between signal conductors in, for example, an electrical cable assembly may include a means for increasing the width of a drain wire as described above. Similarly, it should be appreciated that a means for increasing the density of an electrical cable may include increasing the width of a drain wire as described above. The electrical cable, and thus an electrical cable assembly, may include means for widening a drain wire. For instance, an electrical cable may include means for disposing respective portions of a first electrical signal conductor and a second electrical signal conductor within an insulator; a means for disposing respective portions of first and second drain wires within the insulator; and a means for spacing the first and second drain wires apart from each other along a first direction such that the first and second electrical signal conductors are disposed between the first and second drain wires along the first direction. The first and second drain wires can be elongate along a second direction that is substantially perpendicular to the first direction, and each of the first and second drain wires can define an outer perimeter that has first and second opposed surfaces that are spaced from each other along the first direction. The electrical cable, and thus the electrical cable assembly, can include a means for electrically attaching an auxiliary wire to at least a select one of the first and second drain wires. For instance, the auxiliary wire can define an outer perimeter that can attach to the outer perimeter of at least the select one of the first and second drain wires.

Additionally, an electrical cable, and thus an electrical cable assembly, may include means for defining a first surface of a drain wire of the electrical cable and a second surface of the drain wire that is opposite the first surface. The electrical cable can include means for configuring the first surface to face at least one electrically conductive signal conductor of the electrical cable. The electrical cable can further include means for attaching an electrically conductive auxiliary wire to the second surface of the drain wire so as to define a width that is measured from the first surface to a surface of the auxiliary wire along a straight line, the width being greater than 0.15 millimeters.

What is claimed:

1. An electrical cable assembly comprising:

a plurality of electrical cables arranged in an array extending in a first direction, wherein each of the plurality of electrical cables comprises:

an electrical insulator;

a first electrical signal conductor and a second electrical signal conductor, respective portions of each disposed within the insulator, and each of the first and second electrical signal conductors defining a mounting portion that extends from the insulator and defines a diameter along the first direction;

first and second drain wires having respective portions disposed within the insulator and spaced apart from each other along the first direction such that each of the first and second electrical signal conductors is elongate along its respective length and disposed between the first and second drain wires with respect to the first direction, and each of the first and second drain wires define a mounting portion that extends from the electrical insulator and is configured to attach to a substrate; and first and second electrically conductive auxiliary wires each defining an outer perimeter that is attached to the mounting portion of the first and second drain wires, respectively, such that a straight line along the first direction passes through all of the first and second electrical signal conductors, first and second drain wires, and first and second auxiliary wires wherein a maximum width along the first direction formed by the first or second auxiliary wire attached to a respective first or second drain wire is greater than the diameter.

2. The electrical cable assembly as recited in claim 1, wherein the auxiliary wires are attached to the mounting portion of the respective drain wire via a common pad or an intermediate conductive member.

3. The electrical cable assembly as recited in claim 1, wherein each of the first and second drain wires defines a respective outer perimeter having first and second opposed sides that are spaced from each other along the first direction.

4. The electrical cable assembly as recited in claim 3, wherein the mounting portion defines the first side configured to face the first and second electrical signal conductors, the second side is opposite the first side, and the auxiliary wires are attached to the second side of the respective drain wires.

5. The electrical cable assembly as recited in claim 4, wherein 1) each auxiliary wire defines a first side that is attached to the second side of the one drain wire, and a second side opposite the first side of the auxiliary wire and spaced from the first side of the auxiliary wire an auxiliary distance, and 2) the first and second sides of the mounting portion are spaced from each other a drain distance.

6. The electrical cable assembly as recited in claim 5, wherein the auxiliary wires define a respective third side that is configured to attach to the substrate.

7. The electrical cable assembly as recited in claim 3, wherein the mounting portion defines the first side configured to face the first and second signal conductors, the second side opposite is the first side, and the auxiliary wires are attached to the first side of the respective drain wires.

8. The electrical cable assembly as recited in claim 7, wherein 1) each auxiliary wire defines a first side that is proximate to the first and second signal conductors along the first direction, and a second side that is opposite the first side of the auxiliary wire and attached to the first side of the respective drain wire, the first and second sides of each auxiliary wire spaced from each other an auxiliary distance, and 2) the first and second sides of the mounting portion are spaced from each other a drain distance.

9. The electrical cable assembly as recited in claim 8, wherein the drain distance is substantially equal to the auxiliary distance.

10. The electrical cable assembly as recited in claim 1, wherein the mounting portion is elongate along its length, and each of the auxiliary wires is elongate along its length that is substantially equal to the length of the mounting portion.

11. The electrical cable assembly as recited in claim 1, wherein each of the drain wires is elongate along its length, and each of the auxiliary wires is elongate along its length that is substantially equal to the length of each of the drain wires.

12. The electrical cable assembly as recited in claim 1, wherein only one auxiliary wire is attached to each of the first and second drain wires.

13. The electrical cable assembly as recited in claim 1, the electrical cable assembly further comprising:

the substrate that carries a plurality of signal contact pads and ground contact pads disposed between ones of the signal contact pads, each of the first and second electrical signal conductors mounted to respective signal contact pads and each of the first and second drain wires mounted to respective ground contact pads.

14. The electrical cable assembly as recited in claim 1, wherein the first auxiliary wire is physically adhered to the mounting portion of the first drain wire, and the second auxiliary wire is physically adhered to the mounting portion of the second drain wire.

15. The electrical cable assembly as recited in claim 1, wherein the first and second electrical signal conductors are the only signal conductors disposed between the first and second electrically conductive auxiliary wires along the first direction.

16. A method of fabricating an electrical cable assembly, the cable assembly comprising an array extending in a first direction of a plurality of electrical cables, each electrical cable comprising at least one electrically conductive signal conductor and at least one electrically conductive drain wire, wherein:

a first side of the at least one drain wire faces the at least one electrically conductive signal conductor in an electrical insulator, and a second side of the at least one drain wire is opposite the first side; and the at least one electrical conductive signal conductor defines a diameter along the first direction;

the method comprising:

causing a mounting portion of the at least one drain wire to extend from the insulator, such that the mounting portion is configured to attach to a substrate; and attaching an electrically conductive auxiliary wire to the second side of the mounting portion of the at least one drain wire so as to define a width along the first direction that is measured from the first side to a side of the auxiliary wire along a straight line, the width:

greater than 0.2 millimeters (mm), less than 1.5 mm, greater than a maximum width of the at least one drain wire, and greater than the diameter defined by the at least one conductor, wherein the straight line passes through the at least drain wire, the at least one electrically conductive signal conductor, and the auxiliary wire in the electrical cable.

17. The method as recited in claim 16, wherein the at least one drain wire is a first and second drain wire, and the at least one electrically conductive signal conductor is a first and second electrically conductive signal conductor, the method further comprising:

disposing the first and second electrically conductive signal conductors between the first and second electrically conductive drain wires with respect to a first direction, wherein the first and second sides of each of the first and second drain wires are opposite other with respect to the first direction.

18. The method as recited in claim 17, wherein only one electrically conductive auxiliary wire is attached to each of the first and second drain wires.

19. An electrical cable assembly comprising:

a plurality of electrical cables arranged in an array extending in a first direction, wherein each of the plurality of electrical cables comprises:

an electrical insulator;

a first electrical signal conductor and a second electrical signal conductor, respective portions of each disposed within the insulator and each defining a diameter along the first direction;

first and second drain wires having respective portions disposed within the insulator and spaced apart from each other along the first direction such that each of the first and second electrical signal conductors is disposed between the first and second drain wires with respect to the first direction; and first and second electrically conductive auxiliary wires contacting the first and second drain wires, respectively, such that conducting structures between the first and second signal conductors of adjacent cables formed by the first or second auxiliary wire and a respective first or second drain wire has a width, along the first direction, greater than a maximum width of the drain wire and greater than the diameter.

20. The electrical cable assembly of claim 19, further comprising a substrate that carries a plurality of signal contact pads and ground contact pads disposed between ones of the signal contact pads, each of the first and second electrical signal conductors is mounted to respective signal contact pads and each of the first and second drain wires is mounted to respective ground contact pads.

21. The electrical cable assembly of claim 20, wherein the auxiliary wires are mounted to the same ground contact pad as a respective drain wire.

* * * * *